US006484873B1

(12) United States Patent
Pizarro

(10) Patent No.: US 6,484,873 B1
(45) Date of Patent: Nov. 26, 2002

(54) CUP AND BREATH FRESHENING COMBINATION DEVICE

(76) Inventor: Donna L. Pizarro, 1660 Spruce Drive, Caledon Ontario (CA), L0N 1C0

( * ) Notice: Subject to any disclaimer, the term of this patent is extended or adjusted under 35 U.S.C. 154(b) by 0 days.

(21) Appl. No.: 09/844,374

(22) Filed: Apr. 27, 2001

(51) Int. Cl.[7] ..... B65D 3/26

(52) U.S. Cl. ..... 206/217; 215/386; 229/400; 426/115

(58) Field of Search ..... 206/216–218, 206/459.5; 215/386; 229/400–402; 426/80, 82, 86, 112, 115, 120

(56) References Cited

U.S. PATENT DOCUMENTS

| | | | | | |
|---|---|---|---|---|---|
| 1,770,118 | A | * | 7/1930 | Williams | 206/217 |
| 1,889,111 | A | * | 11/1932 | Serr | 206/217 |
| 2,794,545 | A | | 6/1957 | Olson | |
| 2,972,406 | A | * | 2/1961 | Mayer | 426/86 |
| 3,278,014 | A | | 10/1966 | Thornton | |
| 3,740,239 | A | * | 6/1973 | Chancellor, Jr. | 426/115 |
| 4,726,956 | A | * | 2/1988 | Christie | 426/80 |
| 4,875,574 | A | * | 10/1989 | Travers | 426/80 |
| 4,923,702 | A | | 5/1990 | Powell et al. | |
| 5,024,014 | A | | 6/1991 | Swierczek | |
| 5,137,210 | A | | 8/1992 | Hibbs | |
| D372,398 | S | | 8/1996 | Lamson | |
| 5,584,388 | A | * | 12/1996 | Johnson | 206/217 |
| 5,620,724 | A | * | 4/1997 | Adler | 426/86 |
| 5,635,229 | A | * | 6/1997 | Ray | 426/105 |
| 6,022,570 | A | * | 2/2000 | Richmond | 206/217 |

* cited by examiner

*Primary Examiner*—Jim Foster

(57) ABSTRACT

A cup and breath freshening combination device for providing a breath freshening tab with a coffee cup. The cup and breath freshening combination device includes a cup having a bottom wall and a peripheral wall integrally coupled to and extending upwardly from the bottom wall. A tab is removably attached to the cup. A flavoring is positioned on the tab. The tab is removed from the cup and positioned in a user's mouth for imparting the flavoring to the mouth.

6 Claims, 1 Drawing Sheet

CUP AND BREATH FRESHENING COMBINATION DEVICE

BACKGROUND OF THE INVENTION

1. Field of the Invention

The present invention relates to breath freshening devices and more particularly pertains to a new cup and breath freshening combination device for providing a breath freshening tab with a coffee cup.

2. Description of the Prior Art

The use of breath freshening devices is known in the prior art. More specifically, breath freshening devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,024,014; U.S. Pat. No. 5,137,210; U.S. Pat. No. 4,923,702; U.S. Pat. No. 3,278,014; U.S. Pat. No. 2,794,545; and U.S. Des. Pat. No. 372,398.

While these devices fulfill their respective, particular objectives and requirements, the aforementioned patents do not disclose a new cup and breath freshening combination device. The inventive device includes a cup having a bottom wall and a peripheral wall integrally coupled to and extending upwardly from the bottom wall. A tab is removably attached to the cup. A flavoring is positioned on the tab. The tab is removed from the cup and positioned in a user's mouth for imparting the flavoring to the mouth.

In these respects, the cup and breath freshening combination device according to the present invention substantially departs from the conventional concepts and designs of the prior art, and in so doing provides an apparatus primarily developed for the purpose of providing a breath freshening tab with a coffee cup.

SUMMARY OF THE INVENTION

In view of the foregoing disadvantages inherent in the known types of breath freshening devices now present in the prior art, the present invention provides a new cup and breath freshening combination device construction wherein the same can be utilized for providing a breath freshening tab with a coffee cup.

The general purpose of the present invention, which will be described subsequently in greater detail, is to provide a new cup and breath freshening combination device apparatus and method which has many of the advantages of the breath freshening devices mentioned heretofore and many novel features that result in a new cup and breath freshening combination device which is not anticipated, rendered obvious, suggested, or even implied by any of the prior art breath freshening devices, either alone or in any combination thereof.

To attain this, the present invention generally comprises a cup having a bottom wall and a peripheral wall integrally coupled to and extending upwardly from the bottom wall. A tab is removably attached to the cup. A flavoring is positioned on the tab. The tab is removed from the cup and positioned in a user's mouth for imparting the flavoring to the mouth.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cup and breath freshening combination device apparatus and method which has many of the advantages of the breath freshening devices mentioned heretofore and many novel features that result in a new cup and breath freshening combination device which is not anticipated, rendered obvious, suggested, or even implied by any of the prior art breath freshening devices, either alone or in any combination thereof.

It is another object of the present invention to provide a new cup and breath freshening combination device which may be easily and efficiently manufactured and marketed.

It is a further object of the present invention to provide a new cup and breath freshening combination device which is of a durable and reliable construction.

An even further object of the present invention is to provide a new cup and breath freshening combination device which is susceptible of a low cost of manufacture with regard to both materials and labor, and which accordingly is then susceptible of low prices of sale to the consuming public, thereby making such cup and breath freshening combination device economically available to the buying public.

Still yet another object of the present invention is to provide a new cup and breath freshening combination device which provides in the apparatuses and methods of the prior art some of the advantages thereof, while simultaneously overcoming some of the disadvantages normally associated therewith.

Still another object of the present invention is to provide a new cup and breath freshening combination device for providing a breath freshening tab with a coffee cup.

Yet another object of the present invention is to provide a new cup and breath freshening combination device which includes a cup having a bottom wall and a peripheral wall integrally coupled to and extending upwardly from the bottom wall. A tab is removably attached to the cup. A flavoring is positioned on the tab. The tab is removed from the cup and positioned in a user's mouth for imparting the flavoring to the mouth.

Still yet another object of the present invention is to provide a new cup and breath freshening combination device that conveniently positions a breath freshening tab on a coffee cup which may be used once the user has finished drinking their coffee.

Even still another object of the present invention is to provide a new cup and breath freshening combination device that helps prevent bad breath due to drinking coffee.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
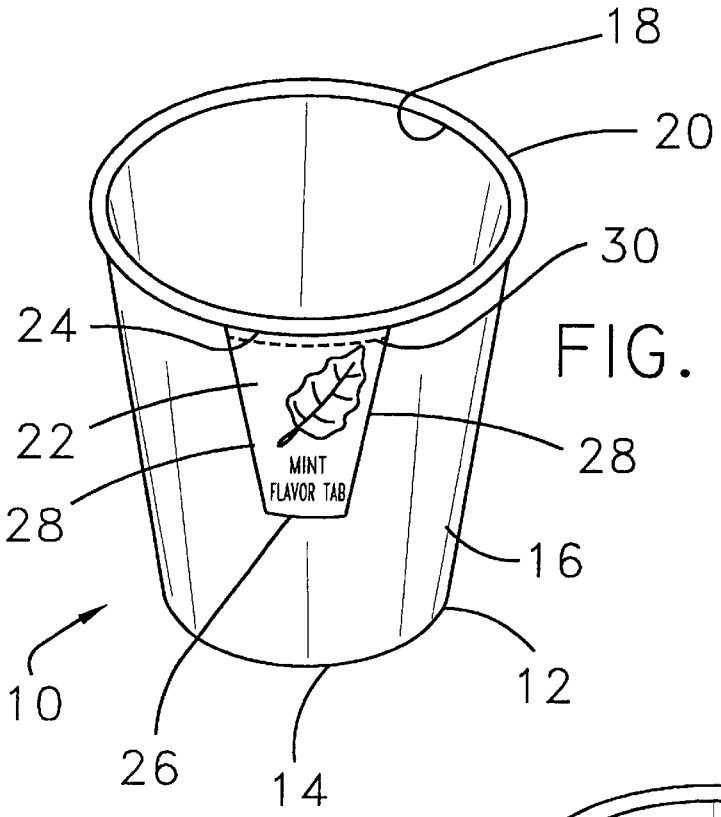
FIG. 1 is a schematic perspective view of a new cup and breath freshening cob on device according to the present invention.
Figure 2:
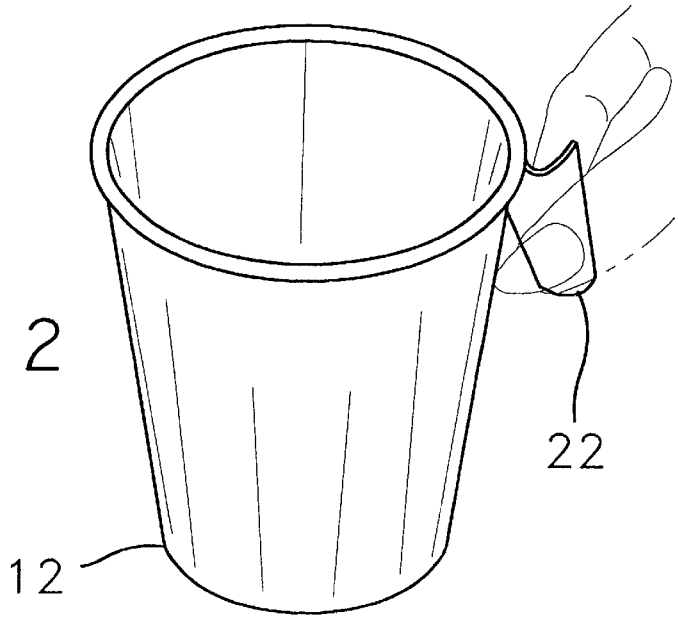
FIG. 2 is a schematic perspective view of the present invention.

With reference now to the drawings, and in particular to FIGS. 1 and 2 thereof, a new cup and breath freshening combination device embodying the principles and concepts of the present invention and generally designated by the reference numeral 10 will be described.

As best illustrated in FIGS. 1 and 6, the cup and breath freshening combination device 10 generally comprises a cup 12 having a bottom wall 14 and a peripheral wall 16 integrally coupled to and extending upwardly from the bottom wall 14. The peripheral wall 16 has a top edge 18 having a perimeter lip 20 attached thereto. The cup 12 comprises a paper material and is a conventional disposable coffee cup.

A tab 22 has a top edge 24, a bottom edge 26 and a pair of lateral side edges 28. The top edge 24 of the tab 22 is attached to the cup 12 at a juncture of the peripheral wall 16 and the perimeter lip 20. The tab 22 has a tear line 30 therein extending between the lateral side edges 28 and positioned generally adjacent to the top edge 24 of the tab. The tear line 30 comprises a plurality of aligned perforations. The tab 11 preferably comprises a paper material.

A flavoring is positioned on the tab 22. The flavoring is preferably selected from the group consisting of mint, peppermint, spearmint, and cinnamon, though any flavoring may be used. The flavoring may be applied by any conventional method including positioning the oil of the selected flavoring on the tab 22.

In use, the tab 22 is removed from the cup 12 and positioned in a user's mouth for imparting the flavor to the mouth. This allows a user to drink coffee and then, when finished with the coffee, to freshen their breath.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable cup and breath freshener combination device comprising:

a cup having a bottom wall and a peripheral wall integrally coupled to and extending upwardly from said bottom wall;

a tab being removably attached to said cup;

a flavoring being positioned on said tab;

wherein said tab is removed from said cup and positioned in a user's mouth for imparting said flavoring to the mouth;

said peripheral wall having a top edge having a perimeter lip attached thereto; and said tab having a top edge, a bottom edge and a pair of lateral side edges, said top edge of said tab being attached to said cup at a juncture of said peripheral wall and said perimeter lip, said tab having a tear line therein extending between said lateral side edges and positioned generally adjacent to said top edge of said tab.

2. The disposable cup and breath freshener combination device as in claim 1, wherein said tear line comprises a plurality of aligned perforations.

3. The disposable cup and breath freshener combination device as in claim 1, wherein said tab comprises a paper material.

4. A disposable cup and breath freshener combination device comprising:

a cup having a bottom wall and a peripheral wall integrally coupled to and extending upwardly from said bottom wall;

a tab being removably attached to said cup;

a flavoring being positioned on said tab;

wherein said tab is removed from said cup and positioned in a user's mouth for imparting said flavoring to the mouth; and wherein said flavoring being selected from the group consisting of mint, peppermint, spearmint, and cinnamon.

5. A disposable cup and breath freshener combination device comprising:

a cup having a bottom wall and a peripheral wall integrally coupled to and extending upwardly from said bottom wall, said peripheral wall having a top edge having a perimeter lip attached thereto, said cup comprising a paper material;

a tab having a top edge, a bottom edge and a pair of lateral side edges, said top edge of said tab being attached to said cup at a juncture of said peripheral wall and said perimeter lip, said tab having a tear line therein extending between said lateral side edges and positioned generally adjacent to said top edge of said tab, said tear line comprising a plurality of aligned perforations, said tab comprising a paper material;

a flavoring being positioned on said tab, said flavoring being selected from the group consisting of mint, peppermint, spearmint, and cinnamon; and wherein said tab is removed from said cup and positioned in a user's mouth for imparting said flavoring to the mouth.

6. A method of providing a disposable cup and breath freshener combination device comprising:

providing a cup having a bottom wall and a peripheral wall integrally coupled to and extending upwardly from said bottom wall, said peripheral wall having a top edge having a perimeter lip attached thereto, said cup comprising a paper material;

providing a tab having a top edge, a bottom edge and a pair of lateral side edges, said top edge of said tab being attached to said cup at a juncture of said peripheral wall and said perimeter lip, said tab having a tear line therein extending between said lateral side edges and positioned generally adjacent to said top edge of said tab, said tear line comprising a plurality of aligned perforations, said tab comprising a paper material;

positioning a flavoring on said tab; and removing said tab from said cup and positioning said tab in a user's mouth for imparting said flavoring to the mouth.

* * * * *